United States Patent [19]

Van Ottele

[11] Patent Number: 4,782,648

[45] Date of Patent: Nov. 8, 1988

[54] DEVICE FOR APPLYING A PRE-TENSIONED BINDING ELEMENT, AROUND OBJECTS

[75] Inventor: Johannes G. W. Van Ottele, Oss, Netherlands

[73] Assignee: 501 Endra B.V., Al Oss, Netherlands

[21] Appl. No.: 931,035

[22] Filed: Nov. 17, 1986

[30] Foreign Application Priority Data

Dec. 6, 1985 [NL] Netherlands ..... 8503373

[51] Int. Cl.[4] ..... B65B 11/08

[52] U.S. Cl. ..... 53/553; 53/586, 53/228

[58] Field of Search ..... 53/553, 556, 228, 389, 53/586

[56] References Cited

U.S. PATENT DOCUMENTS

| | | | |
|---|---|---|---|
| 2,994,997 | 8/1961 | Gwinn | 53/389 X |
| 3,045,403 | 7/1962 | Mitchell | 53/389 X |
| 3,331,312 | 7/1967 | Leslie | 53/589 X |
| 4,024,692 | 5/1977 | Young | 53/228 X |
| 4,177,724 | 12/1979 | Johnson | 53/589 X |
| 4,313,288 | 2/1982 | Tassi | 53/553 X |
| 4,628,668 | 12/1986 | Wildmoser | 53/586 X |

FOREIGN PATENT DOCUMENTS

| | | |
|---|---|---|
| 0061805 | 6/1982 | . |
| 2548786 | 5/1977 | Fed. Rep. of Germany . |

*Primary Examiner*—John Sipos

*Attorney, Agent, or Firm*—John P. Snyder

[57] ABSTRACT

A device is provided for applying a binding material around an object. The object is moved by a conveyor means into a length of binding material that extends across the conveyor path. The binding material is tensioned by a reciprocable tensioning means and the length of material fed to the conveyor path is determined by a brake means that halts the further supply of the binding material in response to a predetermined length of movement of the tensioning means.

7 Claims, 2 Drawing Sheets

DEVICE FOR APPLYING A PRE-TENSIONED BINDING ELEMENT, AROUND OBJECTS

The invention relates to a device for applying a pre-tensioned strapping, wrapping or other binding element of flexible material, such as a thread, a wire, a thin strip, e.g. tape, a thin sheet or film, around an object or a number, e.g. a row or a stack, of objects, said device comprising a track for conveying the object or number of objects, two reels for the supply of binding material, of which pieces emanated from said reels have their ends interconnected and form together a binding element, a portion of which extends over the conveying track transversely of the direction of transport, means for pushing the object or number of objects against said portion of the binding element and for so moving on the object or number of objects, as to bend the binding element around said object or objects in the form of a U, means for successively forcing the portions of the U-shaped binding element which, seen in the direction of transport, protrude beyond the rear side of the object or objects one towards the other, cutting through said portions in the places, in which they have come nearest to one another in order to form four free end portions of binding material nd interconnecting said end portions in pairs, in such a manner, as to ensure that a closed loop of binding material surrounding the object or objects as well as a new binding element consisting of two interconnected pieces of binding material and extending between the reels and across the conveying track for strapping, wrapping or otherwise binding the next following object or objects is formed, means for pulling from the reels before the actual binding operation starts two already interconnected pieces of binding material of sufficient lengths to form together both a closed loop around the object or objects to be strapped, wrapped or otherwise bound and a separate piece of binding material for the next following binding cycle and means for subjecting the binding material pulled from the reels in advance of the actual binding operation to a predetermined tensile stress and maintaining said stress during the latter operation.

A device of this kind has become known by the patent specification DE-A No. 25 48 786. In this known device one or each piece of binding material pulled from a reel is led in a place between said reel and a tensioning system between a supply roller driven by a motor through a make- and -breakable coupling or clutch and a pressure roller cooperating with the supply roller and each reel is loaded by a braking torque, e.g. a friction torque, which must be stronger than that exerted on the reel by the tensioning system. Since the tensile stress to be set up in the binding element is dependent on the nature of the object or objects to be strapped, wrapped or otherwise bound and on that of the binding material to be used the braking torque exerted on the reels must be either stronger than the torque counteracting the braking torque and produced by the maximum tensile stress allowed to be set up in the binding element by the tensioning system or it must be adjustable. Furthermore, the motor for driving the supply roller must be powerful as it has to exert on the respective reel or torque which counteracts the braking torque and is stronger than the maximum value of the latter. These demands made on the known device complicate the construction thereof.

The invention has the object to provide a binding device of the type described hereabove which has a simpler construction, operates smoothly as the supply of binding material does not require much force and owing thereto is able to operate with higher speed. This is achieved in that the means for pulling the binding material from the reels form part of the means for subjecting the piece of binding material pulled from the reels to tensile stress and maintaining said stress in said piece during the forthcoming binding operation. This simplification of the construction of the device makes the use of at least one supply roller, a pressure roller cooperating therewith and a separate motor with clutcs for driving the supply roller superfluous. In any case the reels need not be strongly braked before the supplied piece of binding material has reached its required length and has to be subjected to the desired tensile stress. Low friction brakes which for instance continually engage the reels often suffice to avoid that owing to their inertia the reels rotate on through a part of a revolution, after sufficient binding material for the actual binding operation has been supplied.

If, as in the device known from DE-A No. 25 48 786, the means for subjecting the binding element to tensile stress and maintaining said stress include on one or either side of the conveying track at least one tensioning member, e.g. tensioning roller, acting on the portion of the binding element extending between said track and the respective reel and means for blocking further supply of binding material after pieces thereof of sufficient lengths to form together, during the actual binding operation, both the said closed loop and the separate piece of binding material extending between the reels and across the conveying track and required for the next following binding cycle have been pulled from the reels, it may be advantageous to have the blocking means act directly on the reels and to construct them for being put from an inactive state into an active state and vice versa, said inactive state prevailing during the period of the binding cycle before and said active state prevailing during the period of said cycle after pieces of binding material of sufficient lengths for the binding operation have been pulled from the reels. However, the blocking means may also be constructed as clamping members acting near the reels directly on end portions of the binding element pulled from the reels and for being put from an inactive state into an active state and vice versa, said inactive state prevailing during the period of the binding cycle before and said active state prevailing during the period of said cycle after pieces of binding material of sufficient lengths for the binding operation following thereafter have been pulled from the reels.

It is observed that also in the device disclosed in DE-A No. 25 48 786 clamping members acting on a portion of the binding element are provided. However, these known clamping members are not used for maintaining the original tensile stress set up by the tensioning rollers in the two interconnected pieces of binding material pulled by the motor driven supply roller(s) from the strongly braked reels, but they serve the purpose to enable the means for closing the loop around the object or objects, sealing it and cutting it from the pieces of binding material still connected with the reels to stretch the rear or last portions of the loop additionally.

Advantageously, the or each tensioning member or roller provided on one or either side of the conveying track may be loaded by a pneumatic or hydraulic cylinder-piston-system, of which the active cylinder space is connected to a conduit for the supply and the discharge of fluid under pressure via a pressure limiting device. Such a system facilitates the exact adjustment and maintenance of the tensile stress to be set up in the binding element.

Another advantage of the invention is that, if at least the means for pulling binding material from the reels, subjecting said material to tensile stress and maintaining said stress therein and the blocking means are mounted beside the conveying track on a common detachable plate or other supporting member, the improvement according to the invention is easily applicable to known binding devices, e.g. the device disclosed in EP-A No. 0061805, in which the tensile stress set up in the binding element is defined by the braking torque acting on the reels and the supply of binding material required for the binding operation is carried out by the movement of the object or objects and that of the means for closing, sealing and cutting off the binding loop during the binding cycle.

The invention will be elucidated with the aid of the accompanying drawing, in which.

All three illustrated devices have the purpose to strap, wrap or otherwise bind a horizontal row of objects 1, e.g. footway paving slabs or roofing tiles. To that end said devices comprise each a horizontal conveying track with conveyor belt 2 provided with driving ledges 3 (see FIGS. 1 and 3). It will be understood that the conveying track may also be vertical or inclined, in which cases the transport may be carried out, if necessary, by other means.

Originally, a piece of the required binding element consisting in all three embodiments of two interconnected pieces 6' and 7' of tape emanating from reels 4 and 5 extends transversely over the conveyor belt 2.

Figure 1:
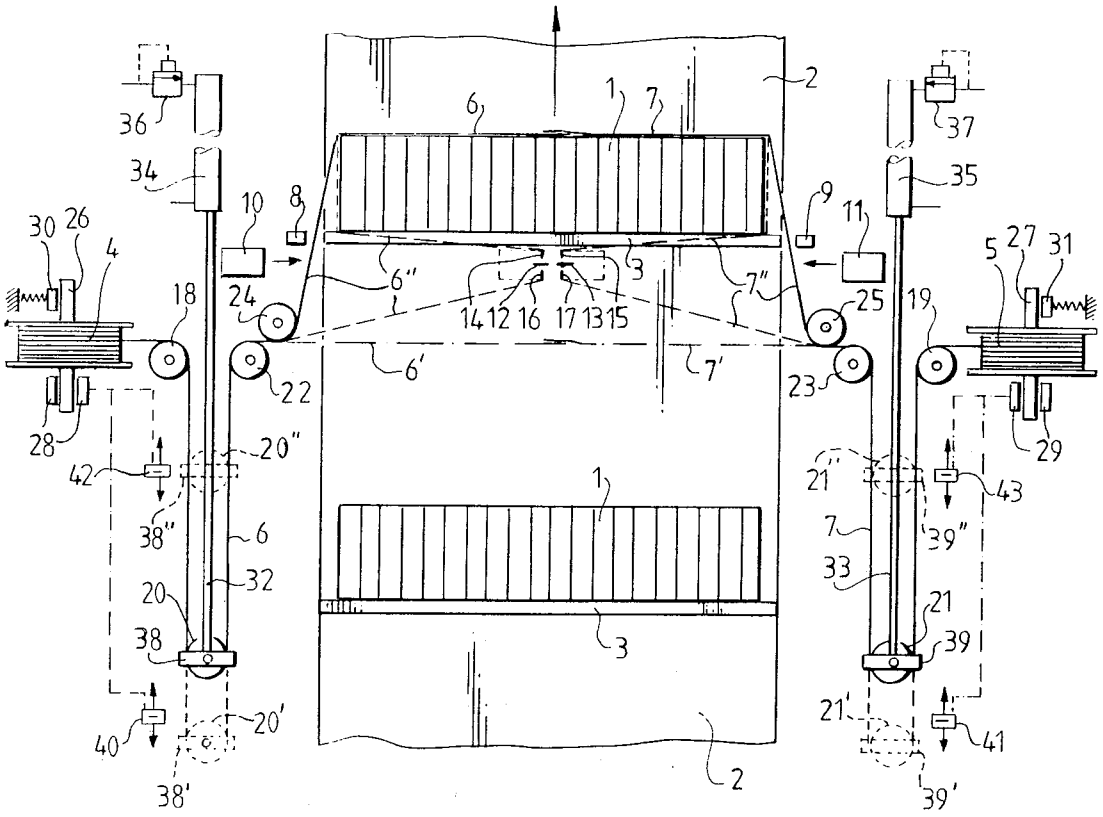
FIG. 1 shows a diagrammatical top view of a first embodiment.

If the row of objects is pushed against the piece 6',7' of tape extending transversely over the conveyor belt 2 and then moved on, the binding element is bent in the shape of a U around three sides of said row, as is shown in FIG. 1. As soon as the rear side of the row of objects has passed photocells 8,9 the conveyor belt is stopped and the pieces of tape protruding from the rear side of the row of objects 1 are engaged by tape manipulators 10,11 described in EP-A No. 0061805, thereafter moved towards one another and cut through in places 12,13, so that end portions 14,15 and 16,17 are formed which are so interconnected in pairs as to form a closed loop of tape around the row of objects 1 on the one hand and a separate piece of binding element consisting of two pieces 6',7' of tape and extending transversely through the conveying track ready for the next following binding cycle on the other hand.

The pieces of tape 6,7 emanating from the reels 4,5 are led over guide rollers 18,19 and tensioning rollers 20,21 and after the latter rollers between the rollers 22,24 and 23,25 to the conveying track. The shafts 26,27 of the reels 4,5 can be firmly held by clamping members 28,29 and are permanently engaged by weak friction brakes 30,31. The tensioning rollers 20,21 are rotatably secured to piston rods 32,33 of pistons (not shown) mounted for reciprocation in cylinders 34,35 of each of which the active cylinder space is connected to a pressure fluid conduit provided with a pressure limiting device 36,37 for keeping the pressure prevailing in said cylinder space constant under all circumstances.

The tensioning roller 20,21 have each two functions which will be explained below.

If the clamping members 28,29 are opened, that means made inactive, so that the reels 4,5 are able to be rotated, although slightly braked by the friction brakes 30,31, pieces 6,7 of tape are pulled from the reels 4,5 by the permanently loaded tensioning rollers 20,21 till said rollers pass with activating members 38,39 connected thereto sensors 40,41. This results in that the clamping members 28,29 are actuated, the reels 4,5 are blocked and thereafter the tensioning rollers 20,21 are able to subject the entire piece of binding element 6,7 pulled from and extending between the reels to a predetermined tensile stress. The task of the friction brakes 30,31 is to prevent that during the pulling of binding material from the reels 4,5, the latter rotate too fast and owing to their inertia supply somewhat more binding material than required.

The sensors 40,41 are situated at some distance from the end of the stroke of the tensioning rollers 20,21 remote from the cylinders 34,35, so that, after the activating members 38,39 have reached the sensors 40,41 and thereby the reels are blocked by the clamping members 28,29, the tensioning rollers 20,21 remain able to move on a bit to stretch the then slack hanging binding element. After this first part of the binding cycle has come to an end the actual binding operation is started. This means that the conveyor belt 2 pushes the row of objects 1 against the tightened portion 6',7' of the binding element and by moving on brings said row into the position shown in FIG. 1, in which said element partly surrounds the row of objects in U-shape. As the reels 4,5 remain blocked the tensioning rollers will then be moved from their extreme positions 20',21', into their positions 20,21. Thereafter the tape manipulators 10,11 are moved behind the row of objects 1 towards one another, whereby the tensioning rollers 20,21 are still further moved in the direction towards the cylinders 34,35 and will finally arrive at positions 20'',21'', in which their activating members 38,39 have reached positions 38'',39'' opposite a second set of delayed action sensors 42,43. This has the effect that after the adjusted delay the clamping members 28,29 are put out of action.

The delayed action of the sensors 42,43 is necessary in order that the tape manipulators 10,11 have sufficient time to cut through the tape pieces 6'',7'' forced in U-shape towards each other and to interconnect the then formed end portions 14,15 and 16,17 of tape in pairs, so as to form a closed loop of tape around the row of objects and a separate piece 6',7' of tape extending between the reels 4,5 to be used for the next following binding cycle.

It will be understood that all sensors 40,41 and 42,43 may be adjustably mounted in the device.

As soon as the clamping members 28,29 have been released the tensioning rollers 20,21 return from their positions 20'',21'' into their extreme positions 20',21', so that again pieces of tape 6,7 of sufficient lengths to complete the next following binding cycle are pulled from the reels.

From the above description it will be apparent that the tensioning rollers 20,21 and their driving means 34,35 have two functions, viz. the pulling of sufficient lengths of tape from the reels and maintaining tensile stress in the tape during the binding operation.

Figure 2:
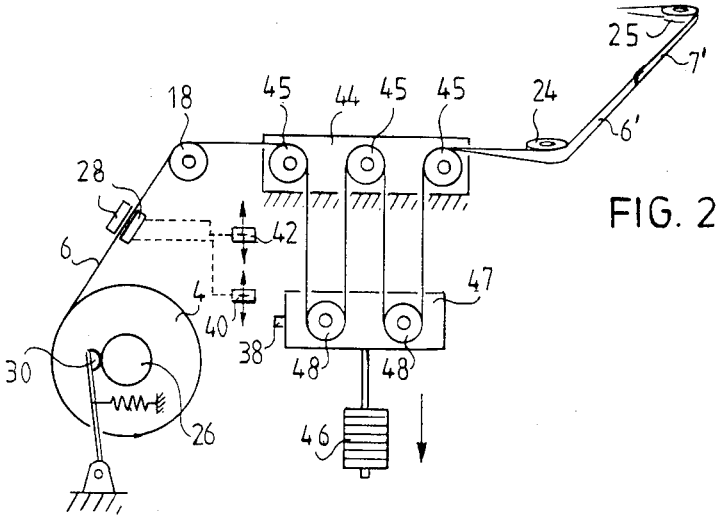
FIG. 2 is a diagrammatically illustrated part of a second embodiment.

In the second embodiment shown in FIG. 2, the cylinders 34, 35, the piston rods 32,33 and the tensioning rollers 20,21 of the device illustrated in FIG. 1 are replaced on either side of the conveyor belt by a set of three guide rollers 45 mounted on a stationary block 44 and a set of two guide rollers 48 provided on a block 47 which is mounted for up and down movement and is loaded by gravity (see weight 46). Furthermore, in said second embodiment the clamping members 28 do not engage the shaft 26 of the reel 4 but they directly engage the tape 6 near said reel. In this case the block 47 is carrying the activating member 38 which cooperates with sensors 40,42. Although FIG. 2 show the device mounted on one side of the conveyor belt (not shown) only, it will be obvious this device operates in the same way as the device illustrated in FIG. 1.

Figure 3:
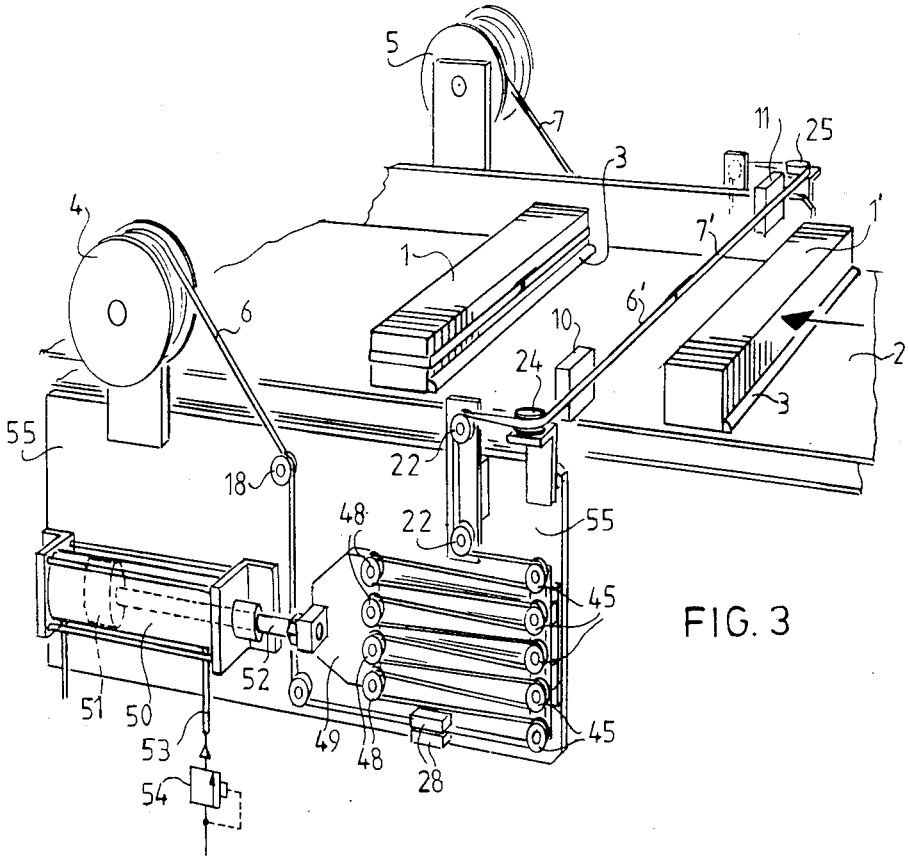
FIG. 3 is a perspective view of a part of a third embodiment of the invention.

FIG. 3 shows a third embodiment, in which the pieces of tape 6,7 are also led over two sets of rollers 45 and 48 mounted for movement towards and from one another. The rollers 45 are mounted on stationary axles and the rollers 48, which act as tensioning rollers, are mounted on axles secured to a plate 49. This plate is mounted for reciprocation and attached to the piston rod 52 of a piston 51 provided in a pneumatic cylinder 50. The active right hand cylinder space is connected to a gas supply conduit 53. The pressure prevailing in the cylinder is kept constant by a pressure limiting device 54.

At least the cylinder with piston 51 and piston rod 52, the plate 49 with the set of guide rollers 45, the tensioning rollers 48, the clamping members 28 engaging the tape directly, the sensors (not shown) and the activating member (not shown) attached to the plate 49 are together mounted on a common supporting plate 55, so that this device can be easily mounted on known devices, e.g. the strapping, wrapping or otherwise binding device described in EP-A No. 0061805.

It is observed that the pneumatic cylinder 50 may also be a hydraulic cylinder connected to a liquid conduit provided with a pressure limiting device.

Furthermore, it will be understood that in some cases it suffices to provide the means for pulling tape from the reels and to tighten the tape on one side of the conveying track only.

What is claimed is:

1. In a wrapping device, the combination of:

conveyer means for transporting batches of goods along a conveying path, supply means for supplying binding material, first brake means for resisting supply of the binding material from the supply means until a first predetermined tension is exceeded, reciprocable tensioning means for subjecting the binding material to a second predetermined tension which is greater than the first predetermined tension, means for moving the tensioning means in one direction of reciprocation to issue binding material from the supply means and establish a length of the binding material sufficient to extend across the conveyer path to be intercepted by a batch of goods and potentially to encircle such batch of goods, second brake means responsive to a predetermined length of movement of the tensioning means in attaining a length of the binding material for halting further supply of the binding material from the supply means and thereby arresting further movement of the tensioning means in the one direction and subject the binding material to the second predetermined tension so that when the binding material extending across the conveyer path is intercepted and bowed forwardly by a leading batch of goods in response to movement of the conveyor means, the intercepting batch of goods takes up and is intimately engaged by a portion of the length of binding material while the tensioning means is moved opposite to said direction by the movement of the binding material to maintain the material under the second predetermined tension due to the resistance in the movement of the tensioning means in said opposite direction, binding means for passing the bowed binding material transversely across the conveying path behind the intercepting batch of goods while further taking up the length of binding material in opposition to the resistance created by further movement of the tensioning means in the opposite direction of movement and for joining the binding material in encircling relation to the batch of goods while the binding material is under the second predetermined tension, whereby the intercepting batch of goods is intimately surrounded by binding material under the second predetermined tension, and brake release means for releasing the second brake means in preparation for a next batch of goods.

2. In a wrapping device as defined in claim 1 wherein the supply means comprises a pair of reels disposed on opposite sides of the conveyer means.

3. In a wrapping device as defined in claim 2 wherein the tensioning means comprises a piston/cylinder device disposed along each side of the conveyer means, each piston carrying an idler roller engaging a loop of binding material, and there being fluid supply means connected to each cylinder for establishing substantially constant tensioning pressure therein.

4. In a wrapping device as defined in claim 1 wherein the tensioning means comprises a piston/cylinder device disposed along each side of the conveyer means, each piston carrying an idler roller engaging a loop of binding material, and there being fluid supply means connected to each cylinder for establishing substantially constant tensioning pressure therein.

5. In a wrapping device as defined in claim 4 wherein the supply means includes guide means for establishing a binding material path extending across the conveying path and including the loops of binding material receiving the rollers.

6. A device for binding batches of goods, comprising the combination of:

conveyer means for transporting batches of goods along a conveying path, supply means at either side of the conveying path for supplying binding material to extend along a binding material path, traveling tensioning means engaging the binding material at regions along the binding material path which are adjacent opposite sides of the conveying path for imparting a predetermined tension in the binding material, means for moving the tensioning means to a fully travelled position to pay off binding material from the supply means while forming at least two loops of binding material in the binding material path to establish a predetermined length of binding material sufficient potentially to encircle a batch of goods, guide means for establishing the binding material path which extends between the supply means and across the conveying path to be intercepted by a batch of goods conveyed therealong, brake means responsive to a predetermined length of movement of the tensioning means in attaining a predetermined length of the binding material for halting further supply of the binding material from the the tensioning means at the fully traveled position thereby to hold the predetermined tension of the binding material along the binding material path between the brake means and in opposition to the tensioning means so that the binding material extending across the conveying path is intercepted and bowed forwardly by a leading batch of goods in response to movement of the conveyer means while the intercepting batch of goods takes up a portion of the predetermined length of binding material while the tensioning means is moved from said fully traveled position to an initial position moved by the movement of the binding material to maintain the material under the predetermined tension due to the resistance in the movement of the tensioning means toward said initial position, binding means for passing the bowed binding material transversely across the conveying path behind the intercepting batch of goods while further taking up the predetermined length of binding material in opposition to the resistance created by and while further traveling the tensioning means to the initial position and for joining the binding material in encircling relation to the batch of goods while the binding material is under the predetermined tension and then cutting through the joined binding material to re-establish the binding material in extending relation across the conveying path, whereby the intercepting batch of goods is surrounded and intimately engaged by binding material under the second predetermined tension, and the binding material extending across the conveying path is also subjected to the second predetermined tension, and brake release means for releasing the brake means and permitting the tensioning means to travel again to fully traveled position in preparation for binding a next batch of goods.

7. A device for binding batches of goods as defined in claim 6 wherein each tensioning means comprises a piston/cylinder device, each piston carrying an idler roller engaging the binding material, and there being fluid supply means connected to each cylinder for establishing substantially constant tensioning pressure therein.

* * * * *